US008622315B2

(12) United States Patent
Ravenhill et al.

(10) Patent No.: US 8,622,315 B2
(45) Date of Patent: Jan. 7, 2014

(54) FLUID INJECTOR HAVING A REED VALVE

(75) Inventors: Paul Bartholomew Ravenhill, Dereham (GB); Richard Matthew Hoolahan, Bunwell (GB); Jeffrey Allen, Attleborough (GB); Steven Barraclough, Wymondham (GB)

(73) Assignee: Robert Bosch GmbH (DE)

( * ) Notice: Subject to any disclaimer, the term of this patent is extended or adjusted under 35 U.S.C. 154(b) by 446 days.

(21) Appl. No.: 12/678,421

(22) PCT Filed: Sep. 22, 2008

(86) PCT No.: PCT/GB2008/003201

§ 371 (c)(1),
(2), (4) Date: Apr. 26, 2010

(87) PCT Pub. No.: WO2009/037486

PCT Pub. Date: Mar. 26, 2009

(65) Prior Publication Data

US 2010/0213287 A1 Aug. 26, 2010

(30) Foreign Application Priority Data

Sep. 20, 2007 (GB) ..... 0718371.8
Aug. 15, 2008 (GB) ..... 0814982.5

(51) Int. Cl.
*F02M 47/02* (2006.01)

(52) U.S. Cl.
USPC ..... 239/91; 239/88; 417/567; 417/571

(58) Field of Classification Search
USPC ..... 239/88, 89, 91, 93–95, 585.1–586; 417/567, 571
See application file for complete search history.

(56) References Cited

U.S. PATENT DOCUMENTS

| | | | | |
|---|---|---|---|---|
| 6,585,500 | B2 * | 7/2003 | Park et al. | 417/549 |
| 2002/0162595 | A1 | 11/2002 | Lee et al. | |
| 2006/0067844 | A1 | 3/2006 | Iversen | |
| 2006/0165537 | A1 | 7/2006 | Hancock et al. | |

FOREIGN PATENT DOCUMENTS

| | | | |
|---|---|---|---|
| CN | 1755108 | A | 4/2006 |
| DE | 102004047159 | | 4/2006 |
| EP | 0318151 | A1 | 5/1989 |
| EP | 0976925 | A2 | 2/2000 |
| EP | 1255042 | A2 | 11/2002 |
| EP | 1936195 | A1 | 6/2008 |

(Continued)

OTHER PUBLICATIONS

Xiaodong Wang, first Office Action issued by the Chinese Patent Office, in Chinese Patent Application No. 200880107792.5—dated Jun. 10, 2011(11 pages).

(Continued)

*Primary Examiner* — Christopher Kim
(74) *Attorney, Agent, or Firm* — Luedeka Neely Group, PC

(57) ABSTRACT

With reference to FIG. 1, the present invention provides a fuel injector (19) comprising a reed valve (35). The reed valve has at least one orifice and at least one reed valve blade, the or each reed valve blade having a valve head attached to at least one resilient spring arm. The or each valve head opens and closes a respective orifice in the valve seat. A support surrounds the reed valve blade(s). Each spring arm extending inwardly from the support. Each spring arm is curved.

10 Claims, 13 Drawing Sheets

(56) References Cited

FOREIGN PATENT DOCUMENTS

| | | | |
|---|---|---|---|
| FR | 671526 | | 12/1929 |
| GB | 250856 | | 5/1925 |
| JP | 04292248 | A | 10/1992 |
| JP | 08268092 | A | 10/1996 |
| JP | 2000120548 | A | 4/2000 |
| JP | 2000274373 | A | 10/2000 |
| JP | 2002530602 | A | 9/2002 |
| WO | 0063557 | | 10/2000 |
| WO | 2005038321 | A1 | 4/2005 |
| WO | 2007-017627 | | 2/2007 |
| WO | 2007029366 | A1 | 3/2007 |
| WO | 2009037486 | A1 | 3/2009 |

OTHER PUBLICATIONS

Application No. GB0718371.8, Patent Act 1977 Combined Search and Examination Report Under Sections 17 and 18 (3), dated Jan. 16, 2008 (7 pages).

International Application No. PCT/GB2008/003201, International Search Report Date of Mailing Mar. 3, 2009 (14 pages).

Japanese Patent Application No. 2010-525436—Office Action—May 1, 2012.

* cited by examiner

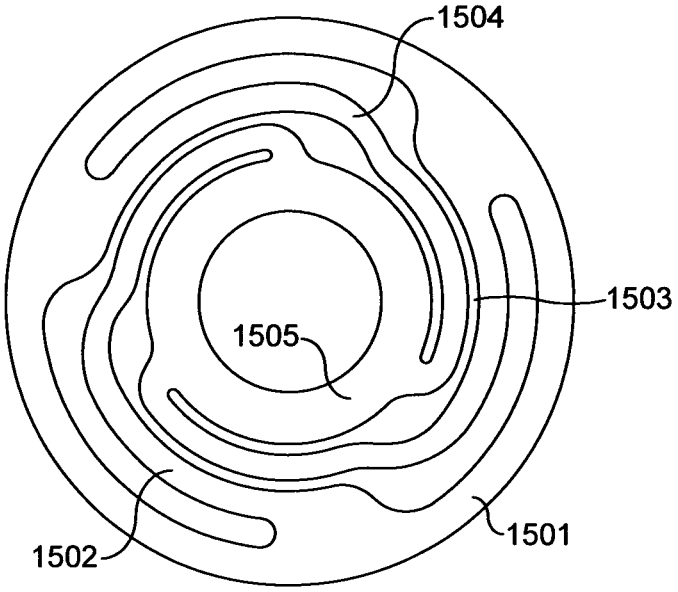
FIG. 15a
FIG. 15b
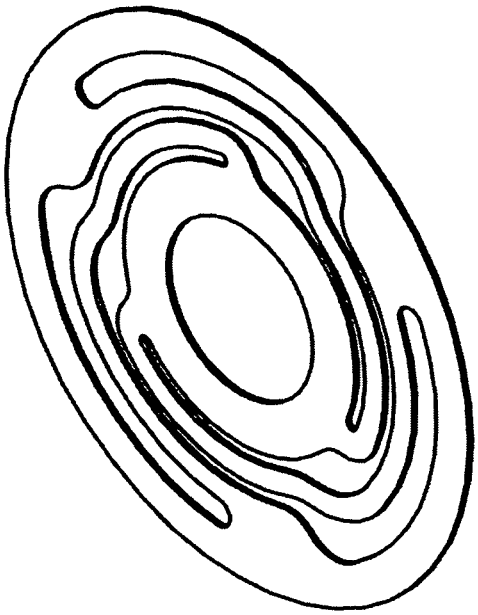
FIG. 15c

FLUID INJECTOR HAVING A REED VALVE

CROSS-REFERENCE TO RELATED APPLICATION

This application claims priority under all applicable rules and statutes to International Application No. PCT/GB2008/003201, filed Sep. 22, 2008, and entitled A FLUID INJECTOR HAVING A REED VALVE, which claims priority to GB 0718371.8 filed 20 Sep. 2007, and GB 0814982.5 filed 15 Aug. 2008, incorporated herein by reference in their entireties.

The present invention relates to a fluid injector having a reed valve, the fluid injector being suitable for injecting gasoline fuel into charge air in an internal combustion engine.

Most internal combustion engines in automobiles currently use fuel injection systems to supply fuel to the combustion chambers of the engine. Fuel injection systems have replaced the earlier technology of carburettors because they give more control of delivery of fuel and enable the engine to meet emission legislation targets as well as improving the overall efficiency of the engine.

Some fuel injectors in current use include a positive displacement pump and one or more one-way valves. A one-way valve may be located at a fuel outlet from the fuel injector, in order to allow fuel to be dispensed from the fuel injector and prevent fuel from returning into the fuel chamber. It is known to use a reed valve as a one-way valve. The reed valve may be a thin flexible strip which is secured at one end. The other end of the blade lies over a fuel outlet. Applied fluid pressure causes the strip to flex and open outwardly, allowing fuel to be dispensed. The reed valve blade closes again due to the resilience of the strip when the pressure decreases.

Known reed valves have the disadvantage that the selection of opening characteristics of the reed valve blades is restricted by the small size of the fuel injector.

The reed valve blade may therefore not open as quickly as desired and/or does not open as wide as desired.

The present invention provides, a fluid injector comprising:

a housing in which a pumping chamber is formed;

a piston which is slidable axially in a bore in the housing to draw fluid into or force fluid out of the pumping chamber;

an electrical coil for generating a field which forces the piston in a first direction;

a biasing spring which acts on the piston to force the piston in a second direction opposite to the first direction;

a fluid inlet;

a fluid outlet;

a one-way inlet valve which allows fluid to be drawn into the pumping chamber from the fluid inlet while preventing fluid being expelled from the pumping chamber to the fluid inlet;

a one-way outlet valve which allows fuel to be expelled from the pumping chamber to the fuel outlet while preventing fuel being drawn into the pumping chamber from the fluid outlet;

wherein:

the one-way inlet valve is a reed valve comprising:

a valve seat comprising at least one orifice;

at least one reed valve blade, the or each reed valve blade having a valve head attached to at least one resilient spring arm, the or each valve head being operable to open and close the/an orifice in the valve seat; and a support for the or each reed valve blade, the or each spring arm extending inwardly from the support; and wherein:

the or each spring arm is curved.

The use of curved arms permits the spring arms to apply biasing force which allows the reed valve to open quickly and/or fully to provide efficient dispensation of fuel from the fuel injector, this being achieved despite space constraints. The invention is ideally suited to dispensing of gasoline fuel, but could be used to dispense other types of fuel or, e.g. in a two-stroke engine, lubricant. The injector could also be used to dispense urea in exhaust gas or to deliver lubricant directly where needed in an engine.

Preferred embodiments of the present invention will now be described with reference to the accompanying drawings, in which.

Figure 1:
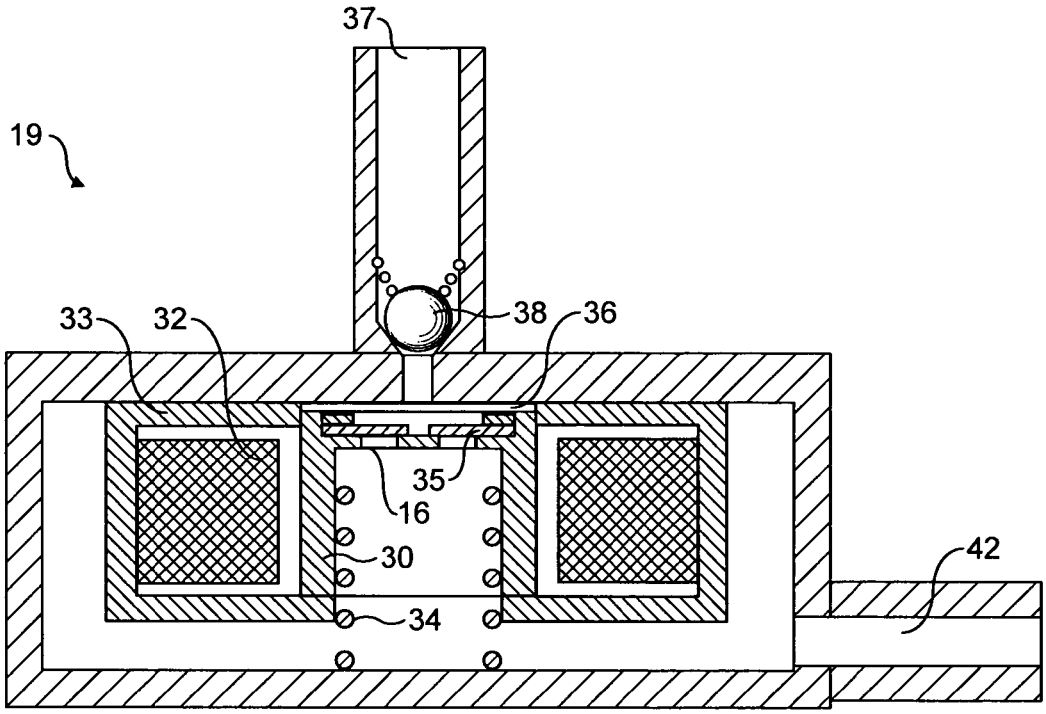
FIG. 1 is a schematic illustration of a fuel injector according to the present invention.
Figure 8A:
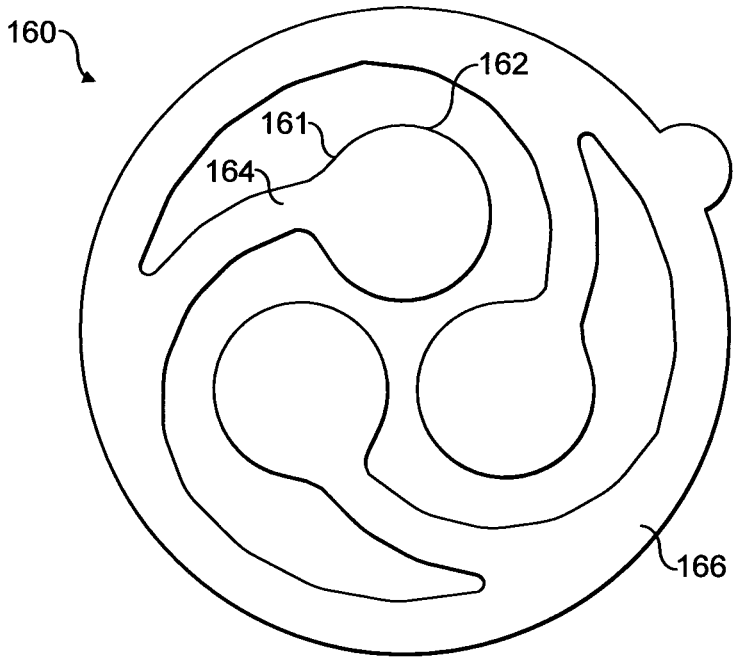
Figure 8B:
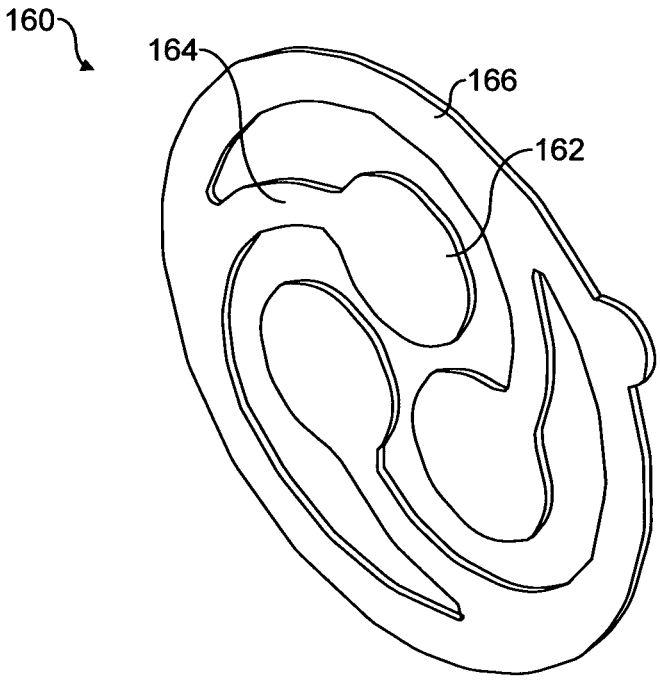

FIG. 8*a* is a plan view of a second embodiment of a reed valve for use in the fluid injector of FIG. 1;

FIG. 8*b* is a perspective view of the reed valve of FIG. 8*a;*

Figure 9A:
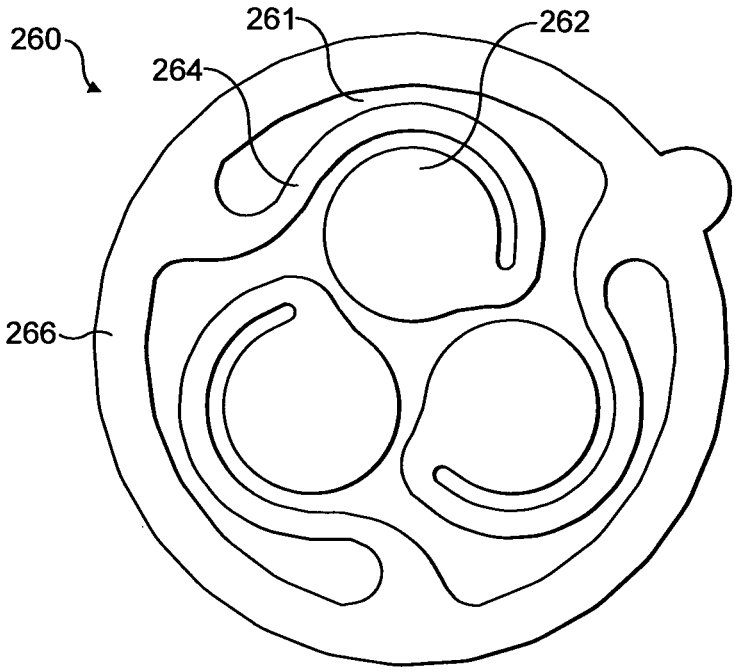
Figure 9B:
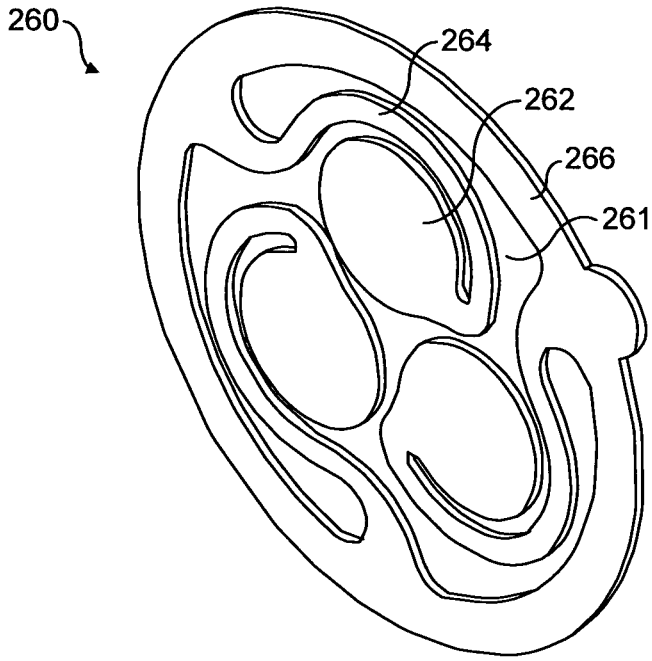

FIG. 9*a* is a plan view of a third embodiment of a reed valve for use in the fluid injector of FIG. 1;

FIG. 9*b* is a perspective view of the reed valve of FIG. 9*a;*

Figure 10A:
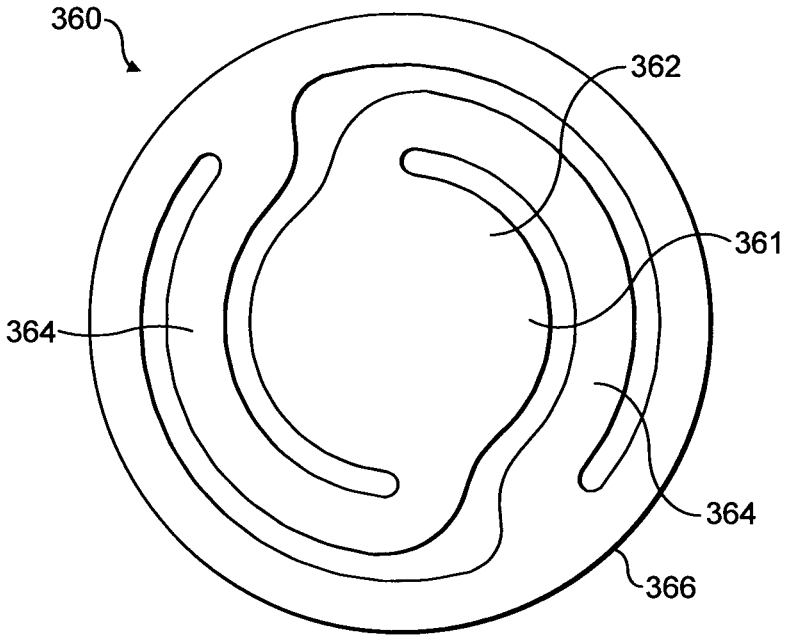
Figure 10B:
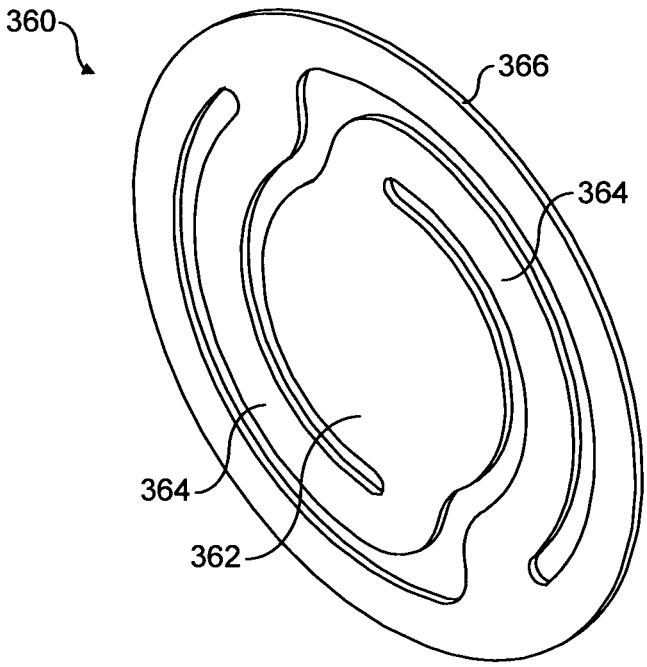

FIG. 10*a* is a plan view of a fourth embodiment of a reed valve for use in the fluid injector of FIG. 1;

FIG. 10*b* is a perspective view of the reed valve of FIG. 10*a;*

Figure 11A:
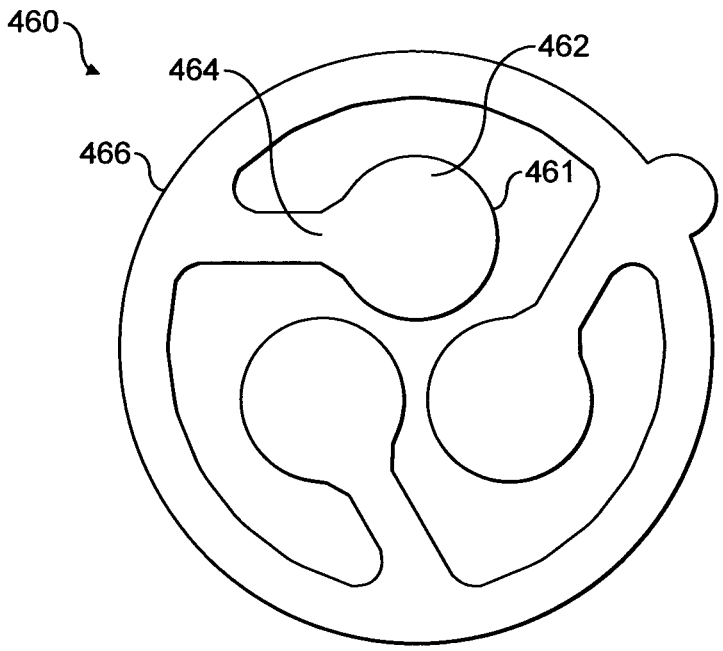
Figure 11B:
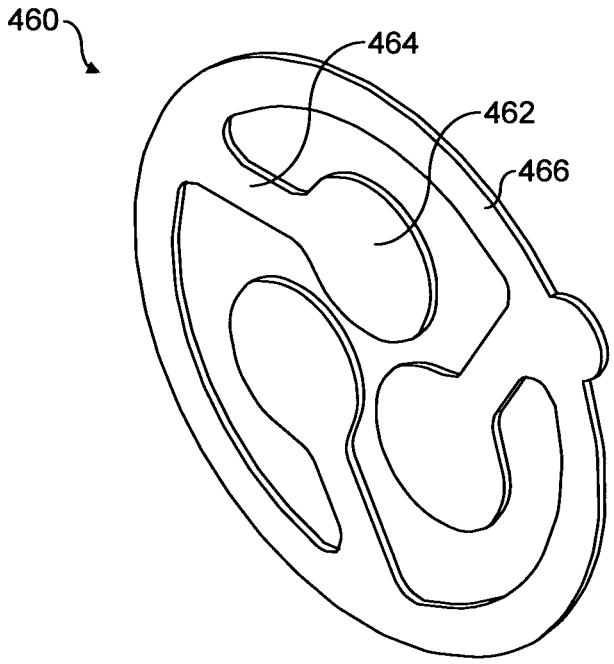

FIG. 11*a* is a front view of a fifth embodiment of a reed valve for use in the fluid injector of FIG. 1;

FIG. 11*b* is a perspective view of the reed valve of FIG. 11*a;*

Figure 13:
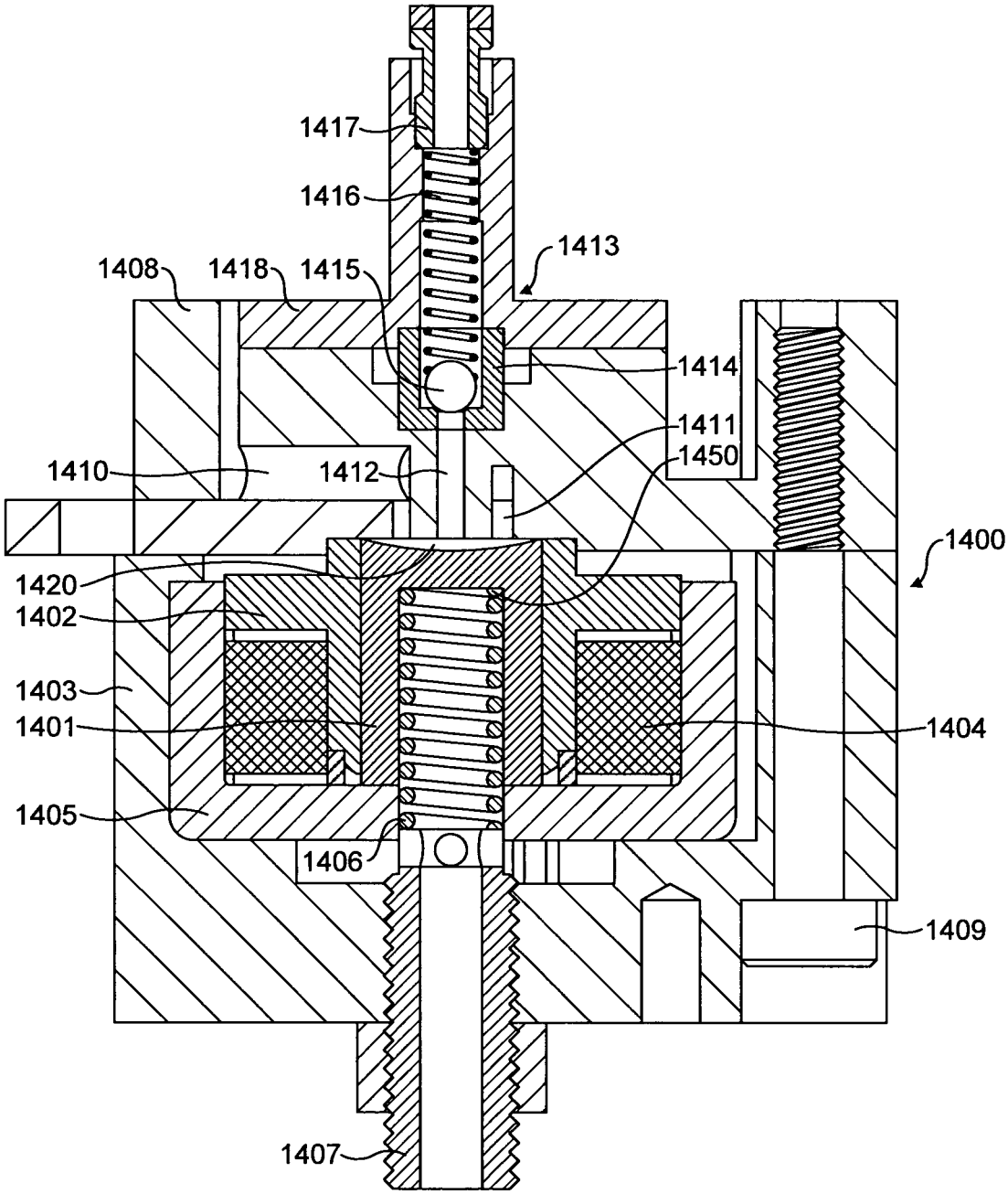
Figure 14:
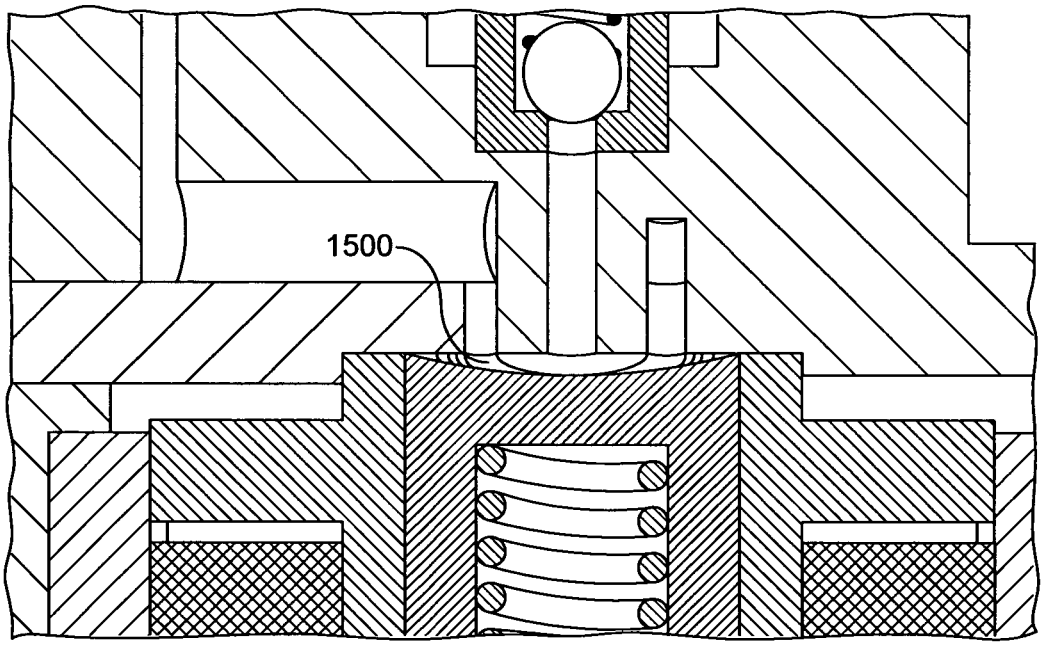

FIGS. 12*a* to 12*d* are schematic illustrations of the fuel injector of FIG. 1 in different stages during use;

FIG. 13 is a cross-section through a second embodiment of a fluid injector according to the present invention;

FIG. 14 is a detail view of a part of the fluid injector of FIG. 13; and FIGS. 15*a*, 15*b* and 15*c* are respectively plan, side and perspective vies of a reed valve suitable for use in the fluid injector of FIG. 14.

The present invention relates to a fluid injector having a reed valve. The fluid injector is for use in an internal combustion engine comprising a cylinder in which reciprocates a piston, with the cylinder and piston defining between them a combustion chamber. The engine is preferably a simple engine, e.g. a single cylinder engine of, for instance, a lawn mower or other garden equipment.

The engine has a fuel injection system comprising a fluid injector according to the present invention arranged to deliver gasoline fuel into an inlet passage upstream of an inlet valve. A throttle valve is placed in the inlet passage to throttle the flow of charge air into the combustion chamber.

FIG. 1 shows a fluid injector 19 with a piston 30 located in a fluid pumping chamber, 36. A fluid inlet 42 is provided for fluid to enter the fluid injector 19 and flow into a fuel passage passing through a piston 30. A one-way inlet valve 35 controls flow of fluid from the inlet passage the pumping chamber 36.

An electrical coil 32 is provided in the injector along with an associated back-iron 33 for generating a field which pulls the piston 30 downwardly (as shown) when the electrical coil 32 is energised, to increase the volume of pumping chamber 36. A piston spring 34 biases the piston 30 away from the back-iron 33 and when the electrical coil is de-energised the spring 34 forces the piston 30 to reduce the volume of the pumping chamber 36 and thereby expel fluid from the pumping chamber 36.

Fluid is dispensed from the pumping chamber 36 to a fluid outlet 37 via a one-way outlet valve 38. The operation of the fuel injector 19 will be described further with reference to FIGS. 12*a*-12*d*.

FIGS. 2 to 11*b* show in detail the one-way inlet reed valve of the fuel injector.

Figure 2:
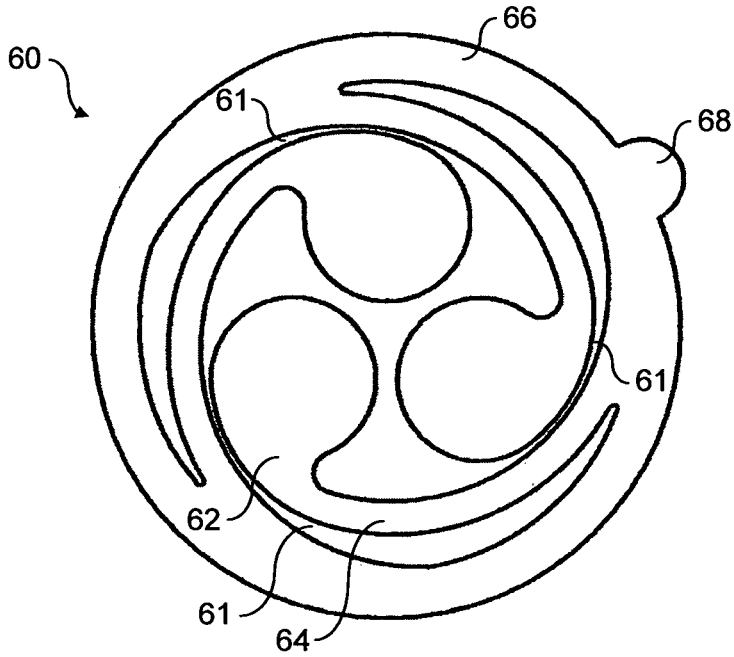
FIG. 2 is a plan view of a first embodiment of a reed valve for use in the fluid injector of FIG. 1.
Figure 3:
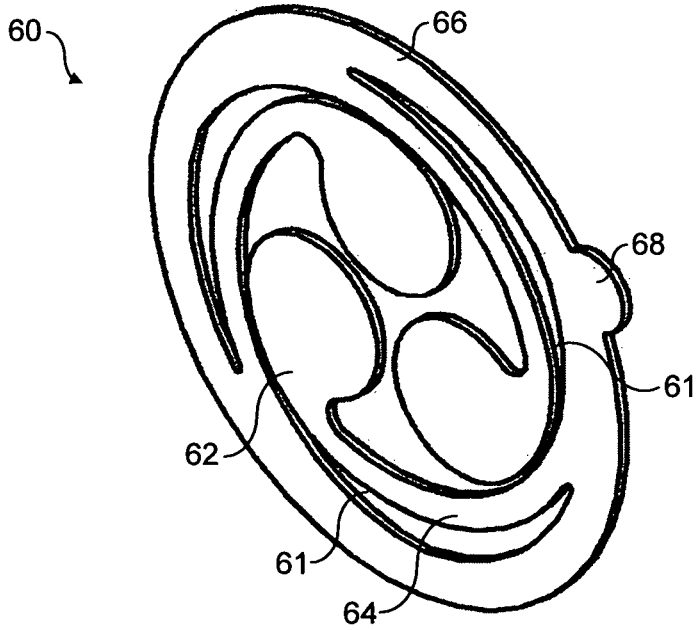
FIG. 3 is a perspective view of the reed valve of FIG. 2.

FIGS. 2 and 3 show a reed valve 60 comprising three independent reed valve blades 61. Each of the reed valve blades 61 has a valve head 62 and a spring arm 64 extending from the valve head 62. The three reed valve blades 61 all extend from a surrounding annular support 66. The reed valve blades are each shaped like a comma, with a circular valve head providing a sealing surface and a curved spring arm extending from the valve head in a swirl-like manner. The curved shape is needed to achieve a desired length of spring arm (a certain length is needed to ensure that the arm provides a desired spring force and a desired range of motion of the valve head whilst not overstretching).

The reed valve 60 is formed from a thin plate of an elastically deformable material, e.g. metal, in particular stainless steel. At rest, the three reed valve blades 61 and rim 66 lie in the same plane. At rest, the valve heads 62 and arms 64 of each reed valve blade 61 also extend in the same plane.

The valve head 62 and spring arm 64 of each reed valve blade 61 are integrally formed. The annular support 66 is integrally formed with the spring arms 64 of the reed valve blades 61.

The arm 64 of each reed valve blade 61 extends from a radially inner surface of the annular rim 66. The three arms 64 are equally spaced around the circumference of the annular support 66.

The arms 64 are curved in the plane (at rest) of the valve heads 62. The arms 64 extend adjacent to the annular support 66. Each arm 64 subtends an angle of approximately 90° of the circumference of the rim. Alternatively, the or each arm 64 can extend across an arc of 30°, 110° or 150°.

Each valve head 62 is substantially disc-shaped. Each valve head 62 has a diameter larger than the width of the spring arm 64 to which it is attached. Each valve head 62 extends radially inwardly of a respective spring arm 64, i.e. the spring arms 64 are connected to the valve heads 66 at a radially outward parts of the valve heads 62. Each valve head 62 and attached arm 64 together form a comma-shaped reed valve blade 61.

Each of the reed valve blades 61 is independently operable. The opening and closing characteristics of the reed valve will depend on the resilience of the arms 64. The curvature of the arms 64 means that the arms 64 have a long length relative to the overall size of the reed valve 60. The curvature of the arms 64 allows them to be located substantially parallel and alongside the annular rim 62. This allows three valve heads to be packaged within a small overall area, each having a relatively long arm 64 to provide a good opening characteristics. Each spring arm 64 has a length greater than a largest dimension of its associated valve head 62. Each spring arm 64 has a width uniform along its length.

The annular support 66 is provided with an alignment protrusion 68 extending radially outwardly. The alignment protrusion 68 can engage in a notch to ensure that the reed valve 60 is properly orientated. The alignment protrusion 68 also inhibits rotation of the reed valve 60 during use.

Figure 4:
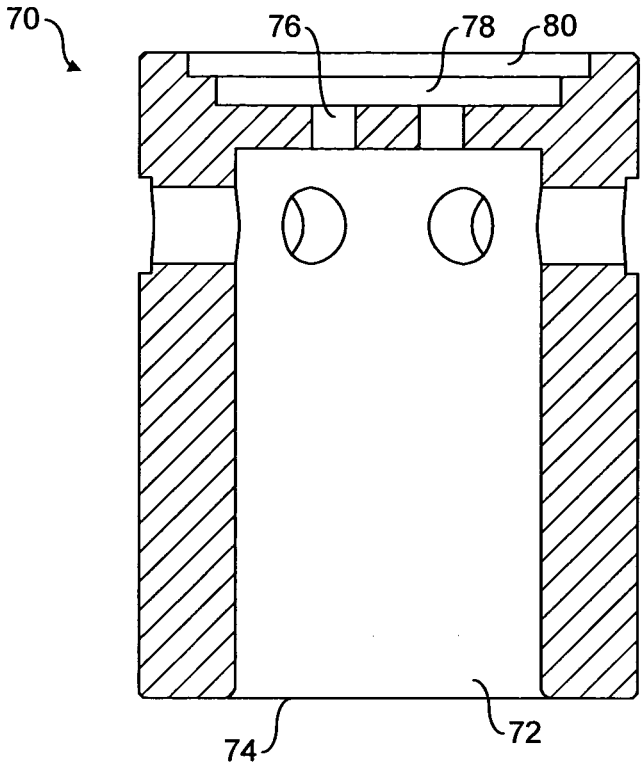
FIG. 4 is a cut-away cross-section view of the piston of the fluid injector of FIG. 1.
Figure 5:
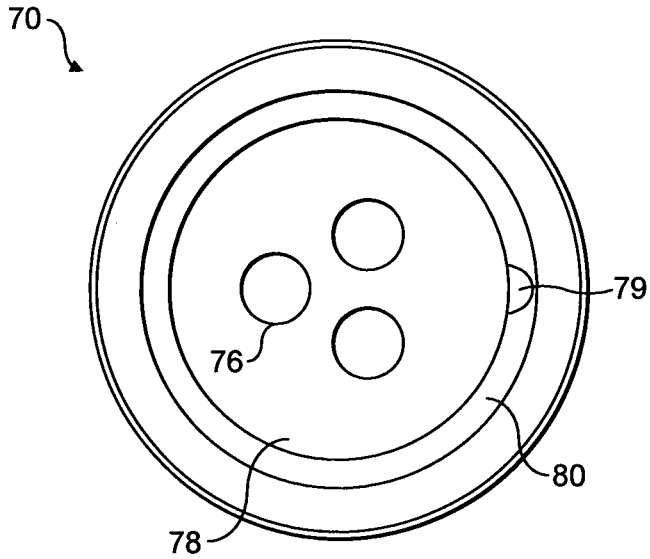
FIG. 5 is an end view of the piston of FIG. 4.

FIGS. 4 and 5 show a piston body 70 forming a part of the piston of FIG. 1. The piston body 70 has a fluid passage 72 through which flows fluid from inlet port 74 to three outlet orifices 76. The outlet orifices 76 open onto a stepped recess forming a valve seat 78 and a cap seat 80. The reed valve 60 shown in FIGS. 2 and 3 is received on the valve seat 78. The alignment protrusion 68 is received in the alignment recess 79. The valve heads 62 are aligned one each with the orifices 76. A cap, as will be described with reference to FIGS. 8 and 9 is received in the cap seat 80 to secure the reed valve 60 in place.

Figure 6:
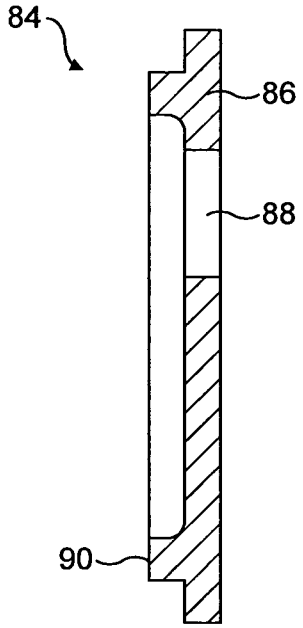
FIG. 6 is a side view of a cap for the piston of FIG. 4.
Figure 7:
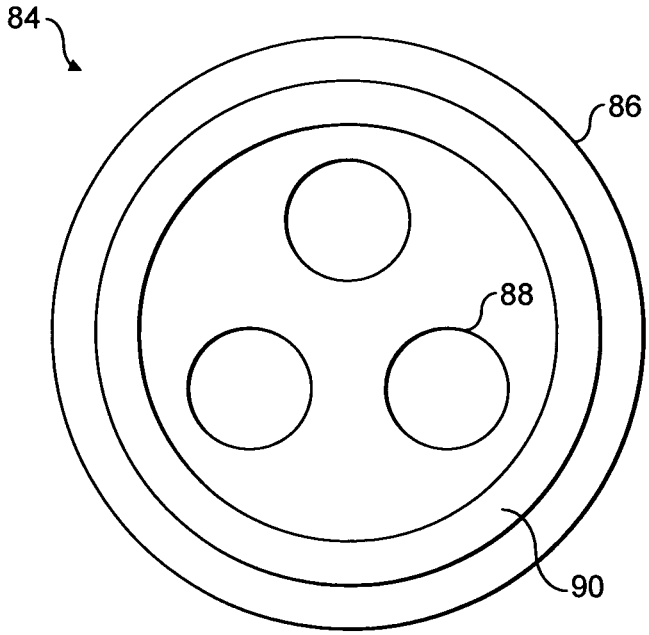
FIG. 7 is an end view of the cap of FIG. 6.

FIGS. 6 and 7 show a cap 84 for attaching to the piston body 70 to keep the reed valve 60 in position. The cap 84 is formed of a plate 86 having three apertures 88. The apertures 88 are aligned with the orifices 76 in the piston body 70, and with the valve heads 62. The apertures 88 have a diameter larger than the valve head 62. The plate 86 is provided with an annular flange 90. The annular flange 90 contacts the annular support 66 of the reed valve 60, and is located in the valve seat 78. The cap 84 as well as holding the reed valve 60 in place also prevents the spring arms overstretching. The reed valve 60 is sandwiched between the valve seat and the cap 84.

Alternatively, the cap 84 may be an annular ring defining a single aperture, extending around the periphery of the reed valve 60. Fluid flowing from each of the outlet orifices 76 would pass through the single aperture. The cap 84 would still retain the reed valve blade assembly in place, and would not limit movement of the reed valve heads.

FIGS. 8*a* to 11*b* show alternate embodiments of reed valves, which can be used in place of the reed valve 60 described above. The location and number of outlet orifices 76 will be varied to ensure that the or each valve head is operable to open and close a respective orifice in the valve seat. The location and size of the or each aperture 88 in the cap 84 may need to be varied to ensure fuel flow through the reed valve when the or each orifice is open.

FIGS. 8*a* and 8*b* show a reed valve 160 comprising three independent reed valve blades. Each of the reed valve blades 161 has a valve head 162 and a resilient curved spring arm 164. The reed valve 160 has an annular support 166 surrounding the reed valve blades 161, the three reed valve blades 161 extending inwardly from the annular support 166.

The reed valve blades 161 are each shaped like a comma, having a circular head 162 and a curved spring arm 164. As each spring arm 164 joins a head 162 it is substantially aligned with a diameter of the valve head 162. This contrasts with the valve blades 61 shown in FIGS. 2 and 3, where the arm 64 joins to the valve head 66 tangentially to a diameter of the valve head 66.

FIGS. 9*a* and 9*b* show a third embodiment of a reed valve 260. The reed valve 260 comprises three independent reed valve blades 261 each having a circular valve head 262 and a resilient curved spring arm 264. The reed blade 260 has an annular support surrounding the three reed valve blades 261 from which the curved spring arms 264 extend inwardly. The curved arms are longer than in the other described embodiments. Each spring arm 264 extends approximately 180° around a periphery of an associated valve head 262, to partially encircle the head 262. Each spring arm 264 is joined to an associated valve head 262 at a side opposite to the side facing the point at which the spring arm 264 join the annular support 266. The reed valve blades 261 are arranged to extend substantially circumferentially alongside the inner surface of the annular support 266, which allows packaging of the three blades 261 within the annular support 266. The long spring arms 264 provide a spring rate suitable for control of opening of the valve heads 262.

FIGS. 10*a* and 10*b* show a fourth embodiment of reed valve 360. The reed valve 360 comprises a single reed valve blade 361 having a valve head 362 and two resilient curved spring arms 364. Each of the curved spring arms 364 is joined to an annular support 366 which surrounds the valve blades 361. The reed valve blades 361 are all located within the surrounding support 366.

Each of the spring arms 364 lies alongside and partially encircles the head 362, each spring arm 364 subtending an angle of approximately 150°. The spring arms 364 extend on opposite sides of the circular head 361.

The presence of two spring arms for a single head means that the head 362 lifts straight up from a valve seat, and remains in a plane perpendicular to the longitudinal axis of an orifice defined by the valve seat. This contrasts with the embodiments having a single arm per head, in which resilient bending of the curved arm means that the valve head is lifted at an angle to the valve seat.

FIGS. 11*a* and 11*b* show a fifth embodiment of a reed valve 460. The reed valve 460 comprises three independent reed valve blades 461. Each of the reed valve blades 461 has a valve head 462 and a resilient straight spring arm 464. The reed valve 460 has an annular support 466 surrounding the reed valve blades 461, the three reed valve blades 461 extending inwardly from the reed valve 466.

At the point that each spring arm 464 joins its respective valve head 462 it is aligned with a diameter of the valve head.

Each spring arm 464 connects a respective valve head 462 to a point on the rim spaced apart circumferentially from the nearest point of the annular support to the valve head 462.

During operation as the piston 30 moves to draw fuel into the fuel chamber the spring arms of the valve blades allow the valve heads to move out of engagement with the valve seat to open the orifices in the valve seat and allow fuel flow. Then when the piston comes to a stop the elasticity in the spring arms returns the valve heads into engagement with the valve seat to close the orifices. During movement of the piston to expel fuel from the fuel chamber both the elasticity of the spring arms and also the pressure differential across the reed valve will keep the valve heads in firm engagement with the valve seat and the orifices in the valve seat remain closed. The cycle will then begin again.

Testing has shown that the reed valves described above performs better than the known disc valves. Partly this is because they close automatically under the spring force in a no flow situation. They achieve a higher operating speed and a better efficiency. The valves improve flow area and gives a smoother flow path (the fluid does not have to flow right around the periphery of a disc); this more than makes up for the initial resistance to opening occasioned by the spring force. The valves in any event improve expulsion of fluid from the chamber by shutting quicker. The reed valves are easy to manufacture.

FIGS. 12*a* to 12*d* show the fuel injector in use. The fuel injector may include the reed valves of any of the described embodiments.

Figure 12A:
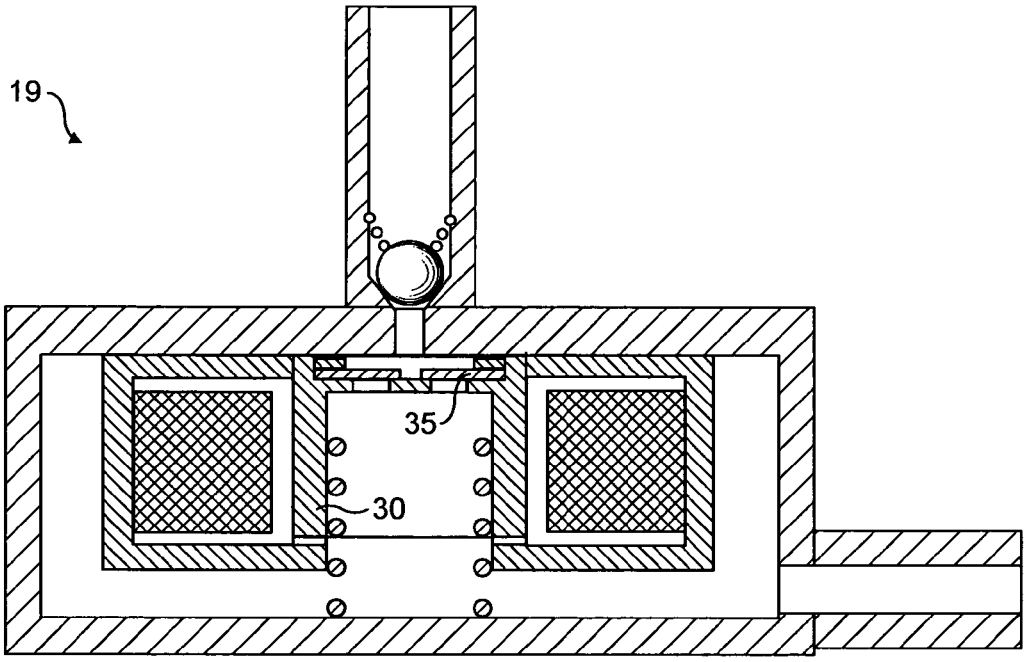

FIG. 12*a* shows the fuel injector 19 when the piston 30 is in its top stop position. The inlet valve 35 is closed, and there is no fluid flow in this position.

Figure 12B:
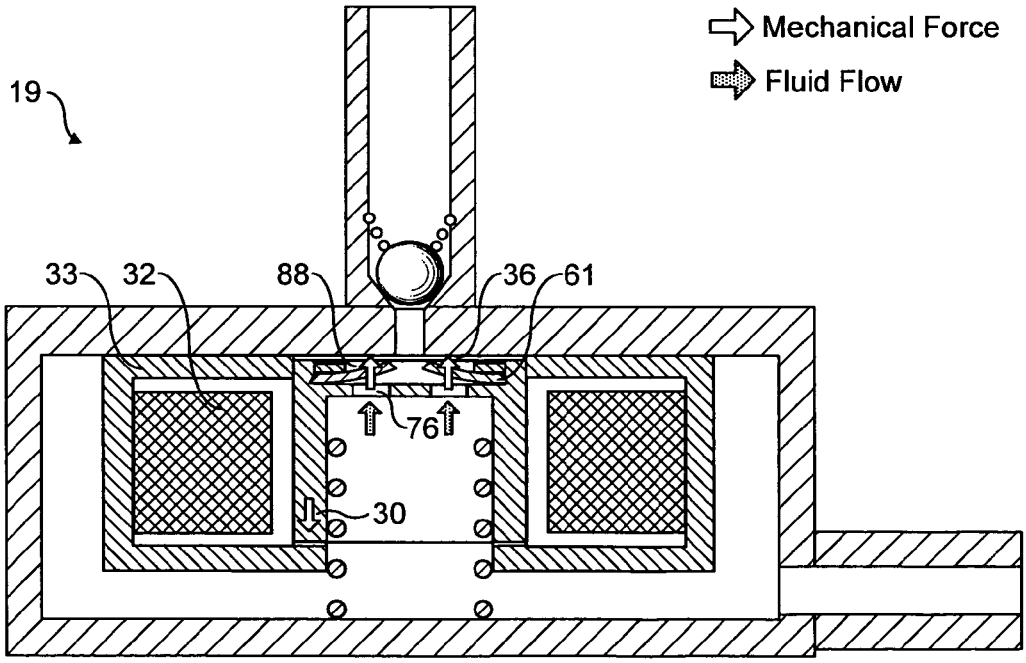

FIG. 12*b* shows the fuel injector 19 with the electrical coil 32 is energised with an electric current. The piston 30 is drawn down by the magnetic flux flowing in the back-iron 33, towards the back-iron 33. The reed valve blades 61 in the check valve 35 are forced upwardly by the fluid within the piston body 30. The inlet check valve 35 opens allowing fluid to flow readily through the orifices 76, around the reed valve blades, and through the orifice(s) 88. Fluid flows into and fills the pumping chamber 36 as the piston 30 continues to move downwards.

Figure 12C:
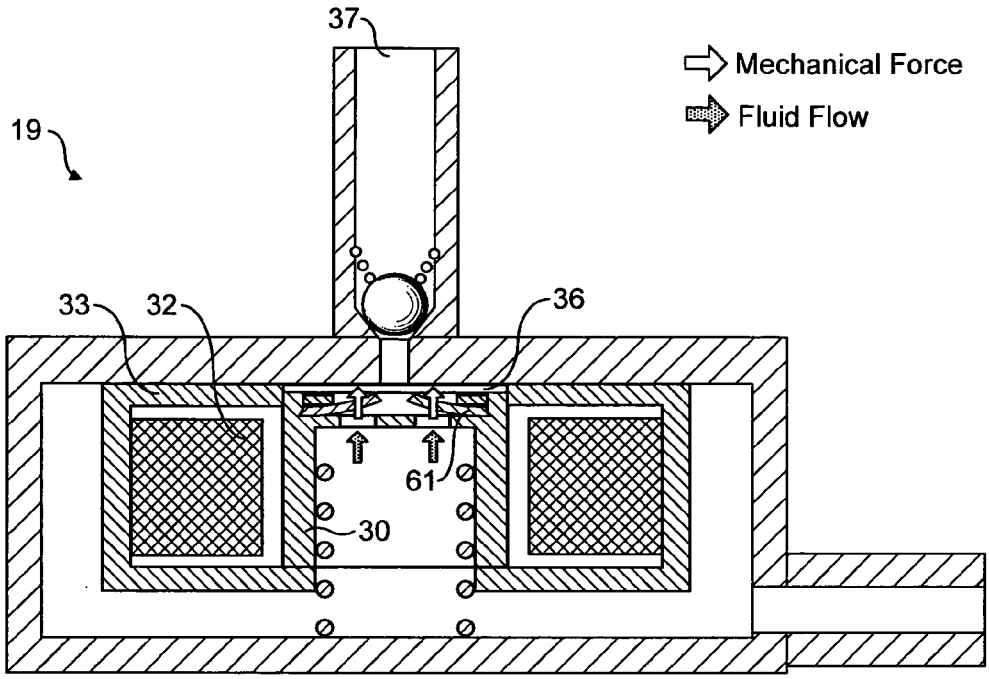

FIG. 12*c* shows the piston 30 pulled into engagement with the back-iron 33 whilst the solenoid 32 is energised. The reed valve blades 61 are still held up (i.e. the valve 35 is open) by fluid continuing to enter the pumping chamber 36.

Figure 12D:
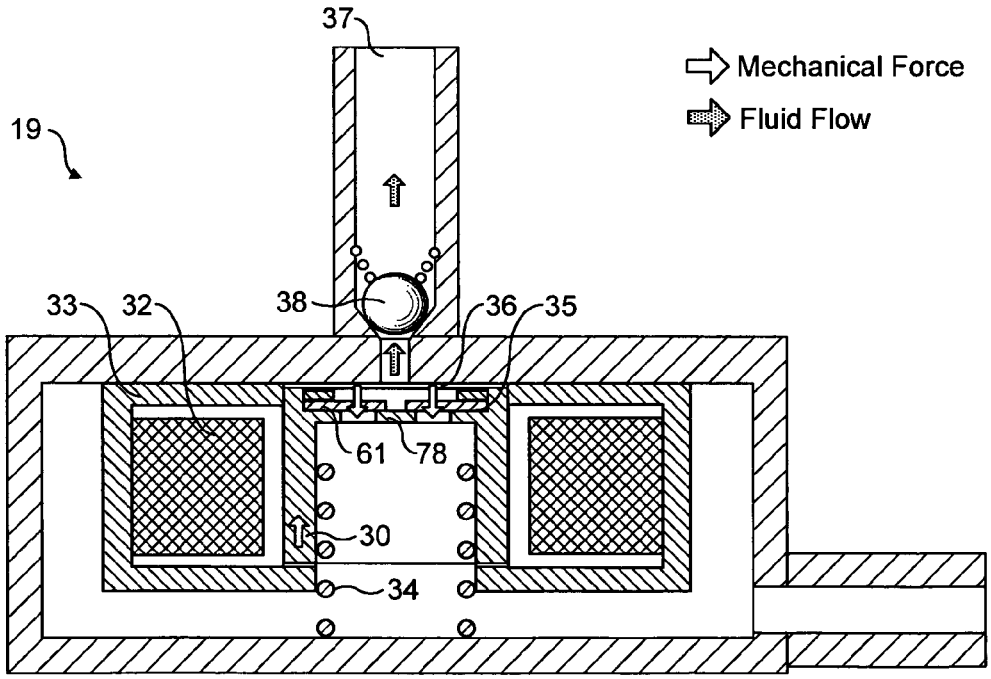

FIG. 12*d* shows the solenoid de-energised. The piston 30 moves upwardly driven by the spring 34. The upward movement of the piston 30 forces fluid out from the pumping chamber 36 via the one-way outlet valve 38. During this movement the reed valve blades 61 are urged against the valve seat 78, and so the inlet valve 35 remains closed. Thus, all the fluid expelled from the pumping chamber 36 flows out through the one-way outlet check valve 38 and out of the fuel injector through the outlet 37.

When the piston 30 reaches its top stop the cycle will begin again from FIG. 12*a*.

In use, it has been found that it is the resilience of the spring arms which closes the valve rather than the pressure differential across the valve.

The electrical coil has been described as drawing the piston back when energised, the spring causing motion of the piston to expel fuel when the solenoid is de-energised. Alternatively, the spring may be configured to draw the piston back and fluid into the pumping chamber, and the electrical coil configured to cause piston motion to expel fuel from the pumping chamber 36 when the electrical coil is energised.

The reed valve has been described as located on a piston of a fuel injector. Alternatively, the reed valve, could be secured to the housing, as will now be described with reference to FIGS. 13, 14 and 15*a* to 15*c*.

FIG. 13 shows a fuel injector 1400 having a piston 1401 slidable in a cylinder 1402 provided by an insert in a cylinder block 1403. An electrical coil 1404 surrounds the cylinder 1402 and is associated with a back iron 1405. A spring 1406 extends between the piston 1401 and a spring force adjuster 1407 which is a spring seat having an external thread threadably engaged in a threaded bore through the cylinder block 1403; the spring force applied by spring 1406 can be adjusted by compressing or decompressing the spring by rotation of the adjuster 1407 relative to the cylinder block 1403. The piston 1401 has a closed bore 1450 and the spring extends into the closed core to engage a closed end thereof.

A cylinder head 1408 is clamped to the cylinder block 1403 by bolts such as 1409. The cylinder head 1408 has a fluid inlet passage 1410 therethrough which terminates in an annular gallery 1411 in the cylinder head 1408. The cylinder block 1408 also has a fluid outlet passage 1412 which opens on to a lower surface of the cylinder head 1408 at a point radially central to the annular gallery 1411. A one-way outlet valve 1413 is formed by a valve seat 1414 secured in a recess in a top surface of the cylinder head 1408 and by a valve member 1415 biased into abutment with the valve seat 145 by a valve spring 1416 which acts between the member 1415 and a spring seat 1417 which is provided by an externally threaded member threadably engaged in a cap 1418 secured to the valve head, with the pre-load of spring 1416 set by rotating the spring seat 1417 relative to the cap 1418. The one-way valve 1413 controls flows of fluid through the outlet passage 1412.

Defined between the piston 1401, the cylinder 1402 and the cylinder head 14 is a pumping chamber 1420. Controlling flow of fluid into the pumping chamber 1420 is a reed valve 1500, shown in situ in FIG. 14 and in detail in FIGS. 15*a*, 15*b* and 15*c*. The reed valve 1500 has an annular support 1501, an annular valve head 1505 and three spring arms 1502, 1503 and 1504 which extend between the annular support 1501 and the annular valve head 1505. The spring arms extend from radially inward points on the annular support 1501 spaced 120° apart around the annular support 1501. The spring arms each extend through an arc of approximately 180°, with the point at which each spring arm joins the annular valve head 1505 lying approximately diametrically across from the point on the valve head 1505 nearest the location of the joining point of the spring arm with the annular support. The reed valve 1500 is formed out of a single sheet of metal.

The reed valve 1500 is secured in place between the insert 1402 and the cylinder head 1408, with the annular valve head 1505 aligned with the annular galley 1411. The valve head 1505 is sprung by the spring arms 1502, 1503 and 1504 to a position in which it seals off the annular galley 1411 and hence the fluid inlet to the pumping chamber 1420. When the piston 1401 slides under influence of the field generated by coil 1404 to increase the volume of the pumping chamber 1420, then reed valve 1500 will open by the annular valve head 1505 opening the annular galley 1411 to the chamber 1420. Then, when the spring 1406 slides the piston 1401 to reduce in volume the chamber 1420 (once the field generated by coil 1404 has died away), the reed valve 1500 will close to prevent fluid flowing back out of pumping chamber 1420 to the inlet 1410, whilst the outlet valve 1413 opens to allow fluid to be expelled from the pumping chamber 1420.

The flow of fluid from an annular inlet to the pumping chamber 1420 to a central outlet 1412 gives good flow characteristics. The location of the fluid inlet in the cylinder head 1408, rather than in the piston (as described in previous embodiments), keeps the fluid away from the heat generated by the coil 1404 in operation. Indeed the head 1408 can be cooled easily. The annular galley 1411 gives a large flow inlet area, which is also advantageous.

The rim surrounding the or each valve blade has been described as annular. Alternatively, the rim may form an ellipse, square, or other regular or non-regular shape.

The valve heads in the above embodiments have been described as substantially circular. Alternatively, the valve heads may be triangular in shape. In one embodiment, three triangular heads may be provided. Each triangular head defines a sector covering just under a third of a circle, and located within an annular rim. A curved arm joins each head to the rim, each curved arm extending substantially circumferentially around the radially outer edge of each head. The apertures in the valve seat may also be triangular in this embodiment. Alternatively, any of the apertures described may be non-circular, i.e. square, rectangular.

In each of the above embodiments the curved arm extends both circumferentially and radially to connect the or each valve head to the rim. For an annular support, the or each spring arm connects a respective valve head to a point on the annular support circumferentially spaced from the point of the annular support closest to where the spring arm meets the valve head. In other words, applicable to a non-circular rim or support, each spring arm connects a respective valve head to a point on the rim spaced apart peripherally from a point of intersection of a line extending from the centre of the rim through the centre of that valve head. This provides for good packaging of one or more valve heads within a certain overall area.

The spring arm in some embodiments extends inwardly from the support into proximity with the valve head, and extends proximal to and spaced apart from the valve head around part of the circumference of the valve head before joining with the valve head. Preferably, the spring arm is proximal to and spaced apart from the valve head for substantially half of the circumference of the valve head.

As an alternative the reed valve blades are arranged on a conical or frustro-conical end surface of a piston, such that the reed valve blades starts with a pre-load which can improve closing of the blades. Alternatively, the reed valve assembly of any of the above described embodiments may be located at the end of an inwardly tapered channel. The tapering of the channel increases the pressure, improving the opening of the blades.

The valve seat of any of the embodiments may be provided with a flange around each the orifices 76. The reed valve head(s) contact the respective flange, and so are spaced apart from the remainder of the valve seat when closed. This may improve sealing of the reed valve heads against the valve seat.

The reed valves of any of the embodiments may be formed with a deformation out of the plane of the annular support, such that at rest they are biased against the valve seat. Such reed valves would therefore be pre-loaded against the opening forces. This would also counter plastic deformation of the reed valves during use, which tends to bend the reed valves upwardly, i.e. away from the valve seat.

In an alternate embodiment, the cap or securing ring may be integrally formed with the piston body, and the valve seat formed as a separate component. The valve seat may be secured in place by the spring which also actuates movement of the piston to expel fuel.

Where in this specification, including the claims, reference is made to 'comma-shaped' this does not require the valve head to be circular in shape and must be read as permitting the valve head to have any shape. The term comma-shaped is used to denote a shape comprising a head portion extending from which is a curved tail.

The reed valves above has been described as having three reed valve blades. Alternatively, four reed valve blades may be located within each annular support.

Any feature of any embodiment may be used with or present in any other embodiment.

The invention claimed is:

1. A fluid injector comprising:

a housing in which a pumping chamber is formed;

a piston which is slidable axially in a bore in the housing to draw fluid into or force fluid out of the pumping chamber;

an electrical coil for generating a field which forces the piston in a first direction;

a biasing spring which acts on the piston to force the piston in a second direction opposite to the first direction;

a fluid outlet;

an annular gallery arranged to surround the fluid outlet;

a fluid inlet which terminates in the annular gallery;

a one-way inlet valve which allows fluid to be drawn into the pumping chamber from the fluid inlet while preventing fluid being expelled from the pumping chamber to the fluid inlet;

a one-way outlet valve which allows fuel to be expelled from the pumping chamber to the fuel outlet while preventing fuel being drawn into the pumping chamber from the fluid outlet and;

a valve seat comprising at least one orifice;

wherein:

the one-way inlet valve is a reed valve comprising:

at least one reed valve blade, the or each reed valve blade having an annular valve head attached to at least one resilient spring arm, the or each valve head being operable to open and close the/an orifice in the valve seat; and a support for the or each reed valve blade, the or each spring arm extending inwardly from the support; and wherein:

the or each spring arm is curved.

2. A fluid injector as claimed in claim 1 wherein the fluid inlet comprises a fluid passage in the housing opening on to an end surface of the pumping chamber facing the piston; and the one-way inlet valve is secured to the housing to control flow of fluid from the fluid inlet in the housing into the pumping chamber.

3. A fluid injector as claimed in claim 1, wherein the support is annular.

4. A fluid injector as claimed in claim 1, wherein the or each of the spring arms is integrally formed with the support.

5. A fluid injector as claimed in claim 1, wherein the or each spring arm has a length greater than a largest dimension of the valve head associated therewith.

6. A fluid injector as claimed in claim 1, wherein the or each spring arm has a width smaller than the diameter of the associated valve head when the valve head is circular.

7. A fluid injector as claimed in claim 1, wherein the or each spring arm has a width substantially uniform along the length of the spring arm.

8. A fluid injector as claimed in claim 1, wherein the or each spring arm extends inwardly from the support towards the valve head and extends around part of a periphery of the valve head before joining with the valve head.

9. A fluid injector as claimed in claim 1, wherein the or each spring arm is curved through an angle of approximately 180°.

10. A fluid injector as claimed in claim 1 wherein the reed valve comprises three spring arms.

* * * * *